US007602930B2

(12) United States Patent
Kasztelan

(10) Patent No.: US 7,602,930 B2
(45) Date of Patent: Oct. 13, 2009

(54) POWER-SAVING MODE FOR HEARING AIDS

(75) Inventor: Thomas Kasztelan, Singapore (SG)

(73) Assignee: Siemens Audiologische Technik GmbH, Erlangen (DE)

( * ) Notice: Subject to any disclaimer, the term of this patent is extended or adjusted under 35 U.S.C. 154(b) by 810 days.

(21) Appl. No.: 11/193,221

(22) Filed: Jul. 29, 2005

(65) Prior Publication Data

US 2006/0023907 A1 Feb. 2, 2006

(30) Foreign Application Priority Data

Jul. 30, 2004 (DE) ..... 10 2004 037 071

(51) Int. Cl.
*H04R 25/00* (2006.01)

(52) U.S. Cl. ..... 381/323; 381/320; 381/321; 381/312

(58) Field of Classification Search ..... 381/23.1, 381/312–331, 103; 181/128–129
See application file for complete search history.

(56) References Cited

U.S. PATENT DOCUMENTS

| | | | | |
|---|---|---|---|---|
| 5,321,758 | A * | 6/1994 | Charpentier et al. | 381/317 |
| 6,044,162 | A * | 3/2000 | Mead et al. | 381/312 |
| 6,115,478 | A * | 9/2000 | Schneider | 381/314 |
| 6,320,969 | B1 * | 11/2001 | Killion | 381/323 |
| 6,516,073 | B1 * | 2/2003 | Schulz et al. | 381/312 |
| 6,904,156 | B1 * | 6/2005 | LeReverend | 381/312 |

* cited by examiner

*Primary Examiner*—Curtis Kuntz
*Assistant Examiner*—Ryan C Robinson

(57) ABSTRACT

Hearing aid wearers can find themselves in situations in which the necessary replacement and/or recharging of a discharged voltage source is not immediately possible. In such a situation, reducing the low-frequency signal elements in the acoustic output signal allows a type of emergency mode to be maintained for a certain period. The majority of important acoustic information thus remains comprehensible to the hearing aid wearer.

8 Claims, 3 Drawing Sheets

POWER-SAVING MODE FOR HEARING AIDS

CROSS REFERENCE TO RELATED APPLICATIONS

This application claims priority to the German application No. 10 2004 037 071.0, filed Jul. 30, 2004 which is incorporated by reference herein in its entirety.

FIELD OF INVENTION

The invention relates to a method for operating a hearing aid and a hearing aid with an input converter, a signal processing unit, an output converter, a voltage source as well as means for monitoring the charge status of the voltage source.

BACKGROUND OF INVENTION

Hearing aids are generally operated using a voltage source in the form of a standard battery or a rechargeable battery. These are generally discharged even after just a few days of operation and must be replaced or recharged. It is thus desirable for the hearing aid wearer to be informed in good time that the voltage source is running down. By way of example, U.S. Pat. No. 6,320,969 discloses a hearing aid which monitors the charge status of the voltage source and warns the user that the voltage source is running down by emitting an acoustic signal.

SUMMARY OF INVENTION

Despite the advance warning, hearing aid wearers repeatedly find themselves in situations in which it is no longer possible to replace a discharged battery and/or recharge a rechargeable battery in good time. With a voltage source that is running down, it is thus preferable to enable a type of 'emergency mode' with restricted functionality of the hearing aid over a longer period of time.

A hearing aid is known from DE 199 41 859 C2, which comprises means for monitoring the status of the voltage source. If the energy stored therein is running out, the clock frequency is reduced by this means and signal processing is switched to a restricted operating mode. Restricted operation of the hearing aid is thereby still possible for a limited period of time with the voltage source deployed.

An object of the present invention is to create an alternative solution to the known problem which can be implemented in a simple manner.

The object is achieved for a hearing aid with an input converter, a signal processing unit, an output converter, a voltage source and means for monitoring the charge status of the voltage source, in that the hearing aid comprises means for reducing the low frequency signal elements in the acoustic output signal as a function of the remaining charge of the voltage source.

The object is further achieved by a method for operating a hearing aid with an input converter, a signal processing unit, an output converter, a voltage source and means for monitoring the charge status of the voltage source with the following steps:

Detecting the charge status of the voltage source,

Reducing the low-frequency signal elements in the acoustic output signal as a function of the charge status.

An input signal is received in a hearing aid and converted to an electrical input signal by means of an input converter. Typically at least one microphone receiving an acoustic input signal serves as an input converter. Modern hearing aids frequently comprise a microphone system with several microphones in order to achieve reception as a function of the incident direction of the acoustic signals or a directional characteristic. The input converters can nevertheless also comprise a telephone coil or an antenna for receiving electromagnetic input signals. By way of example, a hearing aid can be linked to a so-called 'MLX module' in the form of an audio shoe for the wireless reception of a signal transmitted by an external device. The input signals converted to electrical input signals by the input converter are fed to a signal processing unit for further processing and amplification. To compensate for the individual hearing loss of a hearing aid wearer, further processing and amplification generally take place as a function of the signal frequency. The signal processing unit emits an electrical output signal which is fed to the ear of the hearing aid wearer via an output converter, so that said hearing aid wearer perceives the output signal as an acoustic signal. Receivers, which generate an acoustic output signal, are typically used as output converters. Nevertheless output converters for generating mechanical vibration are also known, which directly cause specific parts of the ear to vibrate, the ossicles for example. Output converters are also known which directly stimulate nerve cells of the ear.

The invention is advantageous in that reduction of the low-frequency signal elements in relation to the higher frequency signal elements in the acoustic output signal is a procedure which is technically simple to implement. Unlike a change to the clock frequency of a digital hearing aid, which involves a series of further measures (adjustment of the transmission function, adjustment of filter parameters etc.) no further signal processing adjustments are required when the low frequencies are reduced. Nevertheless majority of the input signals remain comprehensible. The latter is frequently no longer the case, particularly with broadband amplification reduction. Furthermore the low tone reduction does not cause the distortion factor to deteriorate. The hearing aid wearer hears the majority of acoustic input signals with the amplification they require.

The measure according to the invention only gives rise to a sound displacement. In particular the invention hardly has an effect on the transmission of acoustic signals, which are important to the hearing aid wearer. By way of example these are warning signals generated internally or externally to the hearing aid. In particular, the hearing aid wearer can thus hear the internally generated warning signal warning that a voltage source is running down in the amplification they require. The warning notifications are preferably given at periodic intervals by means of voice output and comprise a temporal estimation relating to the period for which the restricted operation according the invention can be maintained.

A reduction of the low-frequency signal elements in the acoustic output signal reduces the power consumption of the hearing aid by up to 80%. From the time when the measure according to the invention takes effect, a remaining life of up to five times longer than would be the case without power-saving measures is possible.

The invention can provide for mechanical means for reducing the low-frequency signal elements in the acoustic output signal. By way of example, an acoustic channel can be automatically shortened or narrowed by means of a small drive mechanism in order to reduce the low elements. With a hearing aid according to the invention, electronic means for reducing low-frequency signal elements in the acoustic output signal are preferably used. These are in particular filter means which can preferably be adapted to different constraints by means of corresponding filter parameters.

The measures according to the invention are always advantageously deployed when the remaining charge of the voltage source used drops below a specific threshold value. This threshold value can be preferably adjusted during the programming of the hearing aid for instance.

A development of the invention provides for several different threshold values relating to the remaining charge of the voltage source used and reduction of the low-frequency signal elements in several stages. By way of example, reduction of the output voltage of the voltage source to around 20 mV below a specific threshold value results in a reduction of 2 dB in the low frequency signal elements respectively.

A further embodiment of the invention provides for a displacement of the cut-off frequency, below which a signal is reduced, if the output voltage of the voltage source reduces further. For instance, signal elements below the cut-off frequency of 400 Hz are reduced if the output voltage of the voltage source drops below a first threshold value. If the output voltage drops below a second threshold value, the cut-off frequency, below which a reduction takes place, is displaced to higher frequencies, e.g. 600 Hz. Naturally more than two threshold values and/or cut-off frequencies can be determined.

In a preferred development of the invention, the reduction of the low-frequency signal elements and/or the displacement of the cut-off frequency, below which a reduction takes place, does not take place in stages but rather continuously as the output voltage of the voltage source reduces. The gradual reduction of the low-frequency signal elements associated with this as a result is hardly perceived by the user at first.

BRIEF DESCRIPTION OF THE DRAWINGS

The invention is described below in more detail with reference to exemplary embodiments, in which.

DETAILED DESCRIPTION OF INVENTION

Figure 1:
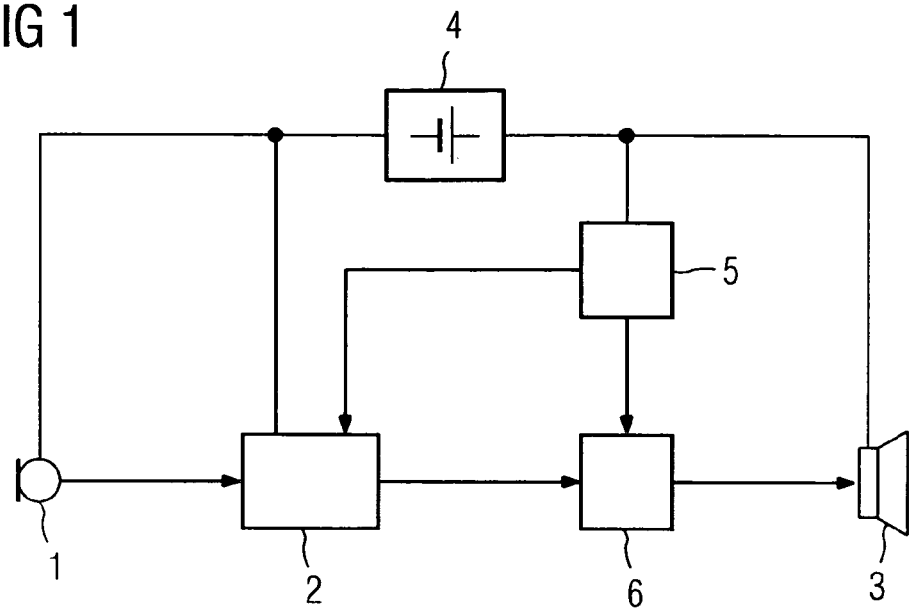
FIG. 1 shows a hearing aid according to the invention with an output filter with an adjustable cut-off frequency to reduce the low frequency signal elements.

FIG. 1 shows a block diagram of a hearing aid with a microphone 1 to receive an acoustic input signal and output an electrical signal. The electric signal is fed to a signal processing unit 2 for further processing and frequency-dependent amplification. During normal operation of the hearing aid, the processed and amplified output signal of the signal processing unit 2 is converted back to an acoustic signal by means of a receiver 3 and is fed to the ear of a hearing aid wearer.

Voltage is supplied to the said components of the hearing aid via a voltage source 4, which is generally designed as a standard battery or a rechargeable battery. The hearing aid further comprises a voltage indicator 5 to warn the user in good time that the standard battery or rechargeable battery is discharging. If the output voltage of the voltage source 4 drops below a specific threshold value, the voltage indicator 5 feeds a warning signal to the signal processing unit 2, which is amplified according to the individual requirements of the respective user and output via the receiver 3.

As a distinctive feature the hearing aid according to the exemplary embodiment comprises filter means 6 for reducing low frequency signal elements in the output signal. This means that the filter means 6 do not necessarily have to be arranged between the signal processing unit 2 and the receiver 3 in the signal path of the hearing aid from the microphone 1 to the receiver 3. Instead, correspondingly designed filter means in any arrangement in the signal path cause reduction of the low frequency signal elements of the acoustic output signal. The filter means 6 could thus also be inserted into the signal path, for instance connected directly to the microphone 1. The filter means 6 are designed as high-pass filters so that higher frequency signal elements can pass unimpeded and low frequency signal elements are suppressed. The filter means 6 however do not permanently influence the transmission behavior of the hearing aid, only doing so if the output voltage of the voltage source 4 drops below a specific, preferably adjustable, threshold value. This threshold value preferably corresponds to the above-mentioned threshold value, at which the acoustic warning signal to the user is generated.

Figure 2:
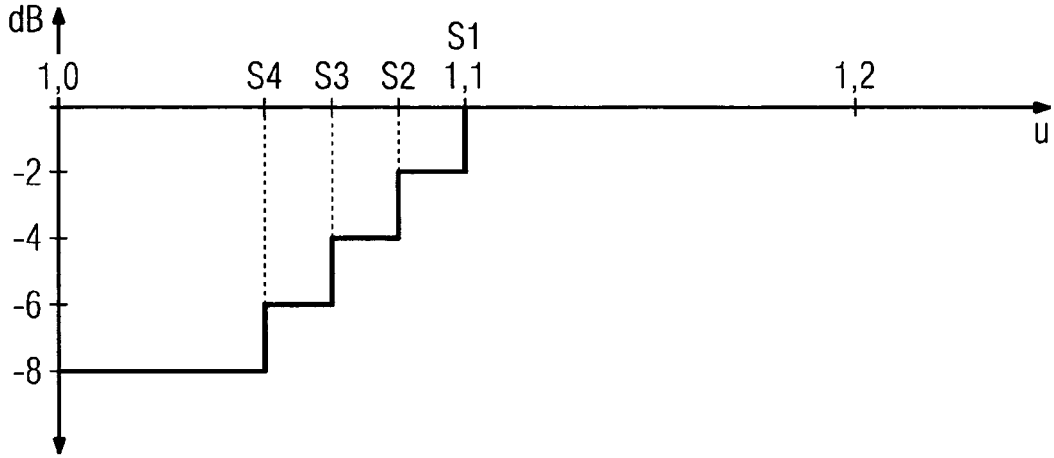
FIG. 2 shows a diagram for illustrating the reduction in several steps.

With one embodiment of the invention, several threshold values can be set in the voltage indicator 5 and the low-frequency signal elements in the output signal are reduced in several stages. An exemplary embodiment relating to this is shown in FIG. 2. The diagram shows that a reduction in the low frequency signal elements of around 2 dB takes place, as soon as the output voltage of the voltage source drops below the first threshold value S1 of 1.1 V. If it drops below the further threshold values S2, S3, S4, the low-frequency signal elements in the output signal are reduced in each instance by a further 2 dB. In the exemplary embodiment according to FIG. 1, the signal is reduced by a corresponding controller of the filter means 6 by means of the voltage indicator 5.

Figure 3:
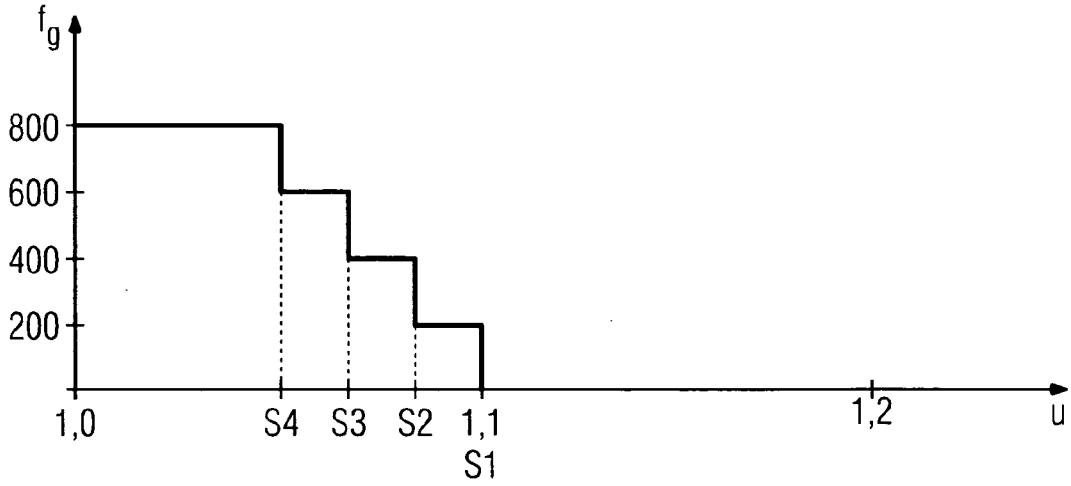
FIG. 3 shows a diagram for illustrating the increase in the cut-off frequency in several steps.

In an alternative embodiment of the invention, the low-frequency signal elements of the output signal are reduced if the output voltage drops below a first threshold value S1 by a constant amount, e.g. −6 dB. To reduce the power consumption, if the output voltage continues to drop, in this exemplary embodiment the cut-off frequency $f_g$, below which a signal is reduced, is raised in stages. This procedure is illustrated in the diagram according to FIG. 3. If the output voltage drops below the threshold value S1, only frequencies below 200 Hz are reduced at first. If the output voltage drops below the threshold value S2, signal elements below 400 Hz in the output signal are reduced. The cut-off frequency $f_g$ is also increased by 200 Hz at the threshold values S3 and S4.

Figure 4:
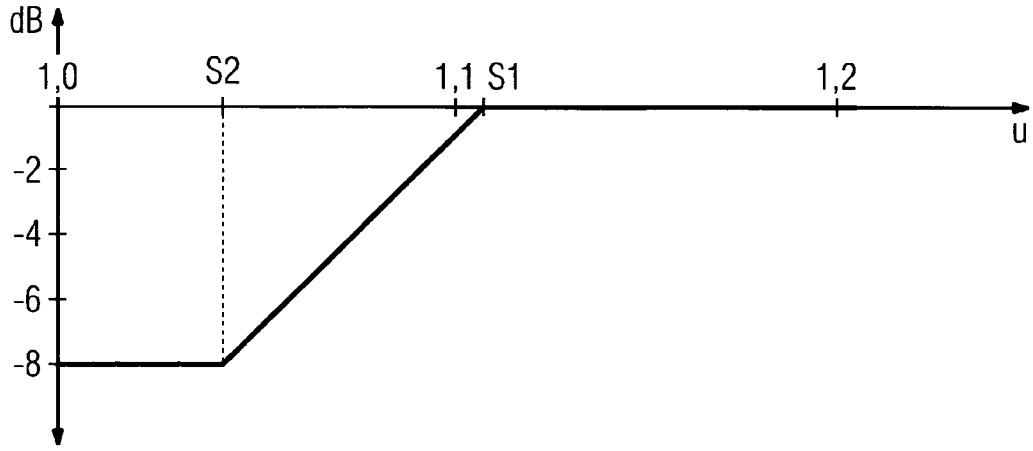
FIG. 4 shows a diagram for illustrating a continuous reduction.
Figure 5:
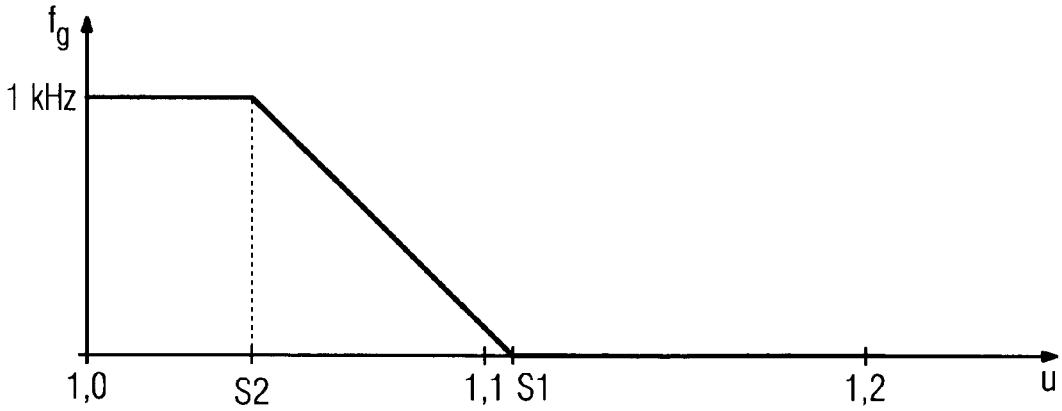
FIG. 5 shows a diagram for illustrating a continuous increase in the cut-off frequency.

The two named measures, i.e. a gradual reduction and a gradual increase in the cut-off frequency, can naturally also be combined. The reduction and displacement of the cut-off frequency can also take place based on a constant characteristic curve, as a function of the output voltage of the voltage source, as shown in FIGS. 4 and 5. According to FIG. 4, if the output voltage drops below the threshold value S1, the low-frequency signal elements are increasingly attenuated in a linear fashion as the output voltage reduces further, until a threshold value S2 is reached, at which the maximum attenuation (−8 dB in the exemplary embodiment) is set. FIG. 5 similarly shows a linear relationship between the output voltage and the cut-off frequency, below which a signal is reduced. The maximum cut-off frequency is around 1 kHz in the exemplary embodiment.

Figure 6:
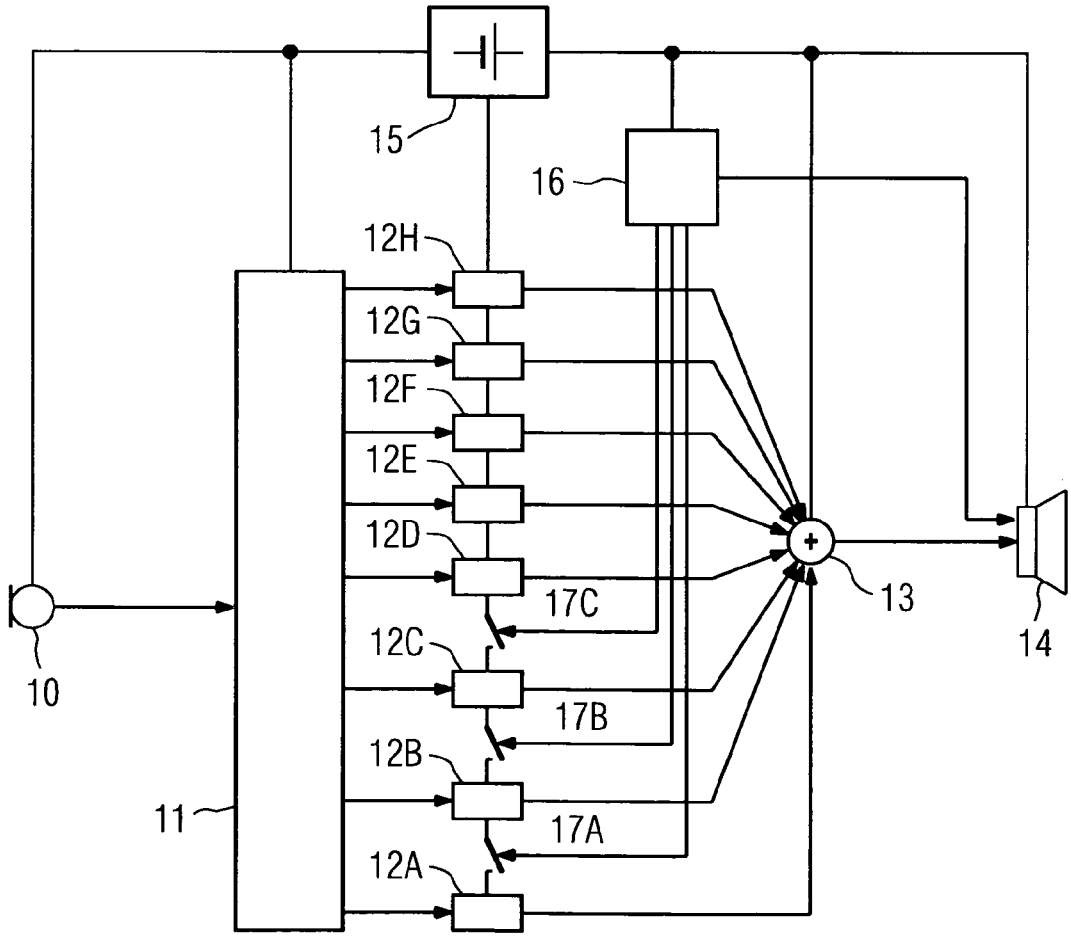
FIG. 6 shows a hearing aid according to the invention with parallel signal processing in several frequency bands.

A further exemplary embodiment of the invention is shown in FIG. 6. In contrast to the exemplary embodiment according to FIG. 1, here the electrical input signal generated by the microphone 10 is first fed to a filter bank 11. Here the electrical input signal is divided into eight frequency bands. Further signal processing in the hearing aid then takes place in parallel in these eight frequency bands. To this end the hearing aid has eight signal processing units 12A to 12H. After processing and frequency-dependent amplification, the signals of the individual channels are combined in a summing unit 13 and finally converted to an electrical signal by means of a receiver 14 and fed to the eardrum of a user. The voltage to the said components of the hearing aid is supplied by means of a voltage source 15. The output voltage of the voltage source 15 is monitored by a voltage indicator 16 in this exemplary embodiment as well. If the output voltage drops below the threshold value, it supplies an output signal directly to the receiver 14 to inform the user of the soon to be required replacement or recharging of the voltage source.

As a distinctive feature, the hearing aid according to the exemplary embodiment in FIG. 6 comprises three switches 17A, 17B and 17C, by means of which the voltage supply to the signal processing units 12A, 12B and 12C can be interrupted. Interrupting the voltage supply causes the frequency band affected by this to be suppressed. For instance, the frequency band 0 to 200 Hz is assigned to the signal processing unit 12A, the voltage supply to which is interrupted by the voltage indicator 16 by opening the switch 17A, if the output voltage of the voltage source 15 drops below a first threshold value S1. If the output voltage drops below a threshold value S2, the second switch 17B is also opened and as a result also suppresses the frequency band from 200 Hz to 400 Hz. The same happens with the third frequency band (400 Hz to 800 Hz) when the third switch 17C is opened, after the output voltage drops below a third threshold value.

The invention provides measures to effectively reduce power consumption, said measures being realizable in a simple manner in different ways. The sound characteristic of the relevant hearing aid is changed by the measure but the majority of the acoustic information for the relevant hearing aid nevertheless remains comprehensible. In particular alarm signals are further transmitted with the amplification required for the hearing aid wearer.

The invention claimed is:

1. A hearing aid, comprising:

an input converter for converting acoustic input signals into electrical signals;

a signal processing unit operatively connected to the input converter for processing the electrical signals and;

an output converter operatively connected to the processing unit for converting the processed electrical signals into acoustic output signals, the acoustic output signals having at least a low frequency part and a high frequency part;

a voltage source for supplying the hearing aid with energy;

a check unit for checking a charge status of the voltage source; and a control unit operatively connected to the check unit and configured to adjust the low frequency part based on the charge status of the voltage source, wherein the control unit is an electronic control unit comprising a filter for attenuating the low frequency part.

2. A hearing aid, comprising:

an input converter for converting acoustic input signals into electrical signals;

a signal processing unit operatively connected to the input converter for processing the electrical signals and;

an output converter operatively connected to the processing unit for converting the processed electrical signals into acoustic output signals, the acoustic output signals having at least a low frequency part and a high frequency part;

a voltage source for supplying the hearing aid with energy;

a check unit for checking a charge status of the voltage source; and a control unit operatively connected to the check unit and configured to adjust the low frequency part based on the charge status of the voltage source;

wherein the low frequency part is attenuated if a output voltage of the voltage source drops below a voltage threshold value and wherein a plurality of threshold values are provided, and the attenuation is executed in stages related to the threshold values.

3. The hearing aid according to claim 2, wherein the threshold value is adjustable.

4. A hearing aid, comprising:

an input converter for converting acoustic input signals into electrical signals;

a signal processing unit operatively connected to the input converter for processing the electrical signals and;

an output converter operatively connected to the processing unit for converting the processed electrical signals into acoustic output signals, the acoustic output signals having at least a low frequency part and a high frequency part;

a voltage source for supplying the hearing aid with energy;

a check unit for checking a charge status of the voltage source; and a control unit operatively connected to the check unit and configured to adjust the low frequency part based on the charge status of the voltage source;

wherein the low frequency part is attenuated if a output voltage of the voltage source drops below a voltage threshold value and wherein a plurality of threshold values are provided, and attenuation of the low frequency part includes shifting a cut-off frequency related to the low frequency part towards higher frequencies based on the threshold values.

5. The hearing aid according to claim 1, wherein the hearing aid is configured to output an acoustic warning signal to a user of the hearing aid, the warning signal related to a low charge status of the voltage source.

6. The hearing aid according to claim 4, wherein the threshold value is adjustable.

7. The hearing aid according to claim 2, wherein the hearing aid is configured to output an acoustic warning signal to a user of the hearing aid, the warning signal related to a low charge status of the voltage source.

8. The hearing aid according to claim 4, wherein the hearing aid is configured to output an acoustic warning signal to a user of the hearing aid, the warning signal related to a low charge status of the voltage source.

* * * * *